United States Patent [19]

Hashimoto et al.

[11] 4,126,372

[45] Nov. 21, 1978

[54] OUTER CONDUCTOR ATTACHMENT APPARATUS FOR COAXIAL CONNECTOR

[75] Inventors: Tetsuo Hashimoto, Tanashi; Yasuo Fukunaga, Musashino, both of Japan

[73] Assignee: Bunker Ramo Corporation, Oak Brook, Ill.

[21] Appl. No.: 807,772

[22] Filed: Jun. 20, 1977

[30] Foreign Application Priority Data

Jun. 25, 1976 [JP] Japan ..... 51-82844[U]

[51] Int. Cl.[2] ..... H01R 17/04

[52] U.S. Cl. ..... 339/177 E; 339/143 R

[58] Field of Search ..... 339/177 R, 177 E, 89 C, 339/90 C, 143 R

[56] References Cited

U.S. PATENT DOCUMENTS

| | | | |
|---|---|---|---|
| 2,449,983 | 9/1948 | Devol | 339/177 R |
| 2,479,483 | 8/1949 | Ekleberry | 339/177 R |
| 3,184,706 | 5/1965 | Atkins | 339/177 R |
| 3,963,321 | 6/1976 | Burger | 339/177 E |
| 4,053,200 | 10/1977 | Pugner | 339/177 R |

FOREIGN PATENT DOCUMENTS

| | | | |
|---|---|---|---|
| 2,286,522 | 4/1976 | France | 339/143 R |

*Primary Examiner*—Joseph H. McGlynn
*Assistant Examiner*—E. F. Desmond
*Attorney, Agent, or Firm*—William Lohff; F. M. Arbuckle

[57] ABSTRACT

An outer conductor attachment apparatus for use with a coaxial cable connector. The apparatus comprises a truncated cone shaped member having a longitudinal passage extending therethrough for insertion of the inner conductors of a coaxial cable. Adjacent the larger end of the cone shaped member, there is an annular groove. An annular locking ring sized to fit into the groove, is expandable so that it can be slid over the cone shaped member and into the groove. A clamping member is securable over the cone shaped member and the ring to clamp the outer conductor between the outer surface of the cone shaped member and the inner surfaces of the clamping member and locking ring.

5 Claims, 7 Drawing Figures

OUTER CONDUCTOR ATTACHMENT APPARATUS FOR COAXIAL CONNECTOR

BACKGROUND OF THE INVENTION

1. Field of the Invention

The present invention relates to the field of coaxial cable connectors, and more particularly to the field of apparatus for securing the outer conductor of the coaxial cable to a connector.

2. Description of the Prior Art

Conventional coaxial connectors employ a fairly complicated apparatus for attaching the outer conductor of the coaxial cable to the connector. Typically, a stop nut, a first washer, a gasket, a second washer, and a hollow ferrule are passed over the prepared end of the cable. The outer conductor is then folded back over the slanted front face of the ferrule. This requires that the tubular outer conductor be folded through an angle greater than 90°. A washer having a slanted rear face is then placed over the cable so that the slanted face is against the folded-back portion of the outer conductor. The entire assembly is then inserted into the connector body and placed under a compressional force, so that the outer conductor is squeezed between the ferrule and the slanted washer.

This type of attachment apparatus was designed for use with cables having tubular outer conductors formed from a sheet of solid material or with outer conductors formed from a ribbon of material spiraled around the inner conductor. The outer conductor of a spiraled cable can effectively be folded only transverse of the cable, while a solid shield cannot be folded back over itself without first slitting it in a number of places. This requires an extra step to prepare the cable end and substantially weakens the outer conductor. In the case of a cable having a ribbon of material spiraled around it, it is often impossible to slit the material without severing the ribbon, thereby shortening the outer conductor to a point where it cannot be engaged by the ferrule.

Additionally, the many parts of the apparatus make the securing operation tedious and exacting.

SUMMARY OF THE INVENTION

It is therefore an object of the present invention to provide an apparatus capable of attaching the outer conductor of any type of coaxial cable to a connector.

It is a further object of the present invention to provide an attachment apparatus which is easy to use and includes only a small number of parts.

It is a still further object of the present invention to provide a conductor attachment apparatus which does not require the outer conductor of a coaxial cable to be folded back over itself.

The present invention satisfied the above objects by providing an apparatus having a truncated cone shaped member having a longitudinal passage therethrough. An annular groove is provided adjacent the larger end of the member. An expandable ring is provided which can be slid over the cone shaped member and locked in the groove. A clamping member is formed having a truncated cone shaped passage therethrough which is similar in size and shape to the cone shaped member.

In use, the insulated inner conductor of the coaxial cable is inserted into the small end and through the passage of the cone shaped member, and the outer conductor of the coaxial cable is deformed over the cone shaped member. The locking ring is then slid over the cone shaped member and the outer conductor and locks a portion of the outer conductor into the groove. The clamping member is then secured over the cone shaped member and locking ring, clamping the outer conductor of the coaxial cable between the outer surface of the cone shaped member and the inner surfaces of the clamping member and locking ring.

This results in a very strong attachment of the coaxial cable to the apparatus, and assures good electrical connection. Since the outer conductor need only be flared out through a small angle to fit over the cone shaped member, the apparatus can be used with coaxial cables having solid or any other type of outer conductor.

BRIEF DESCRIPTION OF THE DRAWINGS

The invention will now be described in detail with reference to the accompanying drawings representing the preferred embodiment of the attachment apparatus according to the present invention. In the drawings.

DESCRIPTION OF THE PREFERRED EMBODIMENTS

Figure 1:
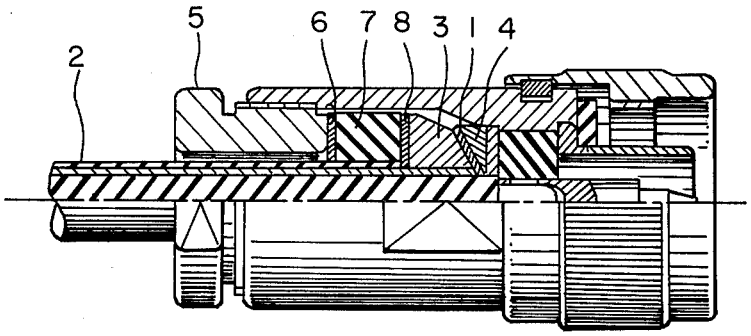
FIG. 1. (PRIOR ART)
FIG. 1 is a partial cutaway elevational view of a coaxial connector showing a prior art attachment apparatus.

FIG. 1 shows a connector of the prior art, in which outer conductor 1 of coaxial cable 2 is folded back through an angle greater than 90° and squeezed between the slanted face of ferrule 3 and slanted washer 4. Stop nut 5 forces washer 6, gasket 7, and second washer 8 against the ferrule 3.

Figure 2A:
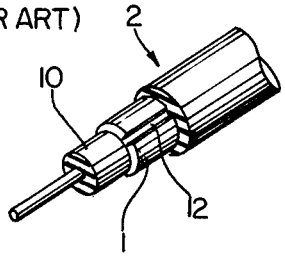
FIGS. 2*a*, *b*, and *c* are perspective views showing the prepared ends of various types of coaxial cables.
Figure 2B:
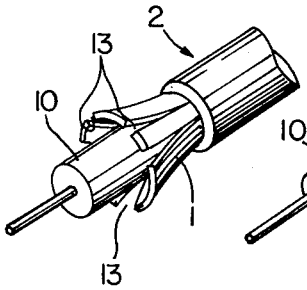

In order to use the above described connector with a coaxial cable having an essentially tubular outer conductor 1 formed by wrapping a sheet of solid material around insulation 10, leaving joint 12 (see FIG. 2*a*), the outer conductor 1 must be slit at a plurality of places 13 as shown in FIG. 2*b*.

Figure 2C:
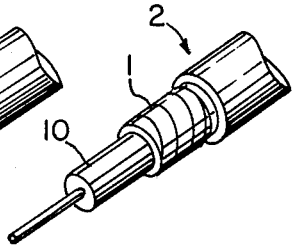

Great difficulty is encountered when the coaxial cable has an outer conductor 1 formed by spiralling a ribbon of material around the insulation 10 (as shown in FIG. 2*c*), since the ribbon of material cannot be folded back over itself as required for engagement between the ferrule 3 and the washer 4.

Figure 3:
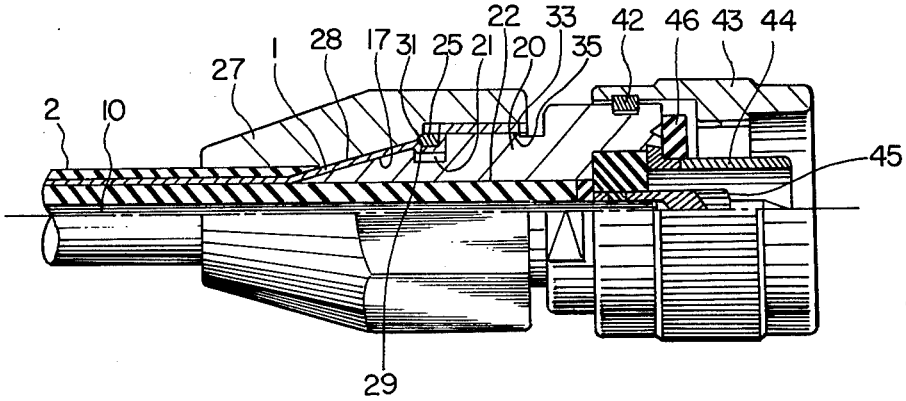
FIG. 3 is a partial cutaway elevational view of a coaxial connector having an attachment apparatus according to the present invention.

The attachment apparatus of the present invention is shown in FIG. 3. A truncated cone shaped member 20 includes a narrow annular groove 21 defining an outer surface 23 and axial passageway 22. Annular locking ring 25 is circumferentially resilient and has, in its unstressed state, an internal diameter greater than the diameter of groove 21. The ring 21 also has a thickness permitting its circumferential contraction into groove 21 and a camming surface 26 adapted to receive and engage a cooperating clamping member 27. Clamping member 27 includes truncated cone shaped passage 28 which is similar in size and shape to cone shaped member 20.

In use, the outer conductor 1 of cable 2 is clamped between the outer surfaces 17 and 23 of truncated cone shaped member 20 and the inner surfaces 28 of clamping member 27 and 29 of locking ring 25. Locking ring 25 is squeezed into groove 21 by engagement section 31 of clamping member 27 which acts against camming surface 26. Engagement section 31 may be in the form of an annular shoulder on inner surface 28.

Clamping member 27 may include threaded portion 33 engageable with threaded portion 35 of truncated cone shaped member 20.

Additionally, cone shaped member 20 may include fastening device 42 for fastening connector elements 43 through 46 to the apparatus.

Figure 4:
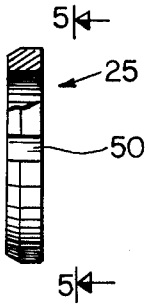
FIG. 4 is a partial cutaway view of the locking ring of the present invention.
Figure 5:
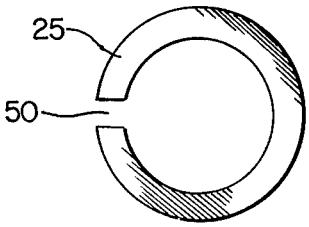
FIG. 5 is an elevational view taken along a line 5—5 of FIG. 4.

As shown in FIGS. 4 and 5, annular locking ring 25 includes slit 50 to allow the ring to expand and contract in diameter, so as to snap fit into groove 21.

The device of the present invention allows for a much easier assembly of coaxial connectors and can be used with coaxial cables having any type of outer conductor. This results in a great savings in assembly time and inventory and at the same time provides an attachment of the connector to the outer conductor of the cable which is superior to that provided by conventional attachment apparatus.

From the foregoing, it can be readily realized that this invention can assume various embodiments. Thus, it is to be understood that the invention is not limited to the specific embodiments described herein, but is to be limited only by the appended claims.

The embodiments of the invention in which an exclusive property or privilege is claimed are defined as follows:

1. An outer conductor attachment apparatus for use with a coaxial cable connector, said apparatus comprising: a truncated cone shaped member having a longitudinal passageway therethrough, an outer conical major surface and a narrow annular groove adjacent the larger end of said member defining an outer cylindrical minor surface; a circumferentially resilient annular locking ring receivable in said groove and having an internal diameter in the unstressed free state greater than the diameter of said annular groove, said ring also having a circumferential camming surface; and a clamping member slidable over said cone shaped member and said ring, said clamping member having a truncated cone shaped passage therethrough sized to receive the outer major surface of said cone shaped member, said passage including a section for engaging said camming surface to force said ring into said groove; whereby the essentially tubular outer conductor of a coaxial cable inserted in said apparatus is deformed over said cone shaped member and into said groove, and clamped between the outer major and minor surfaces of said cone shaped member and the inner surfaces of said clamping member and said ring.

2. The apparatus as claimed in claim 1, wherein said cone shaped member further includes screw means adjacent said groove, and said clamping member includes mating screw means adjacent said engagement section for screwably connecting said clamping section and said cone shaped section.

3. The apparatus as claimed in claim 1, wherein said clamping member includes an end section having a cable passage therethrough, said cable passage being coaxial with, and communicating with, said cone shaped passage.

4. The apparatus as claimed in claim 1, wherein said cone shaped member includes fastening means for attaching said cone shaped member to a coaxial connector.

5. The apparatus as claimed in claim 1, wherein said cone shaped member includes connector means forming a coaxial connector integral therewith.

* * * * *